United States Patent [19]

Galais et al.

[11] Patent Number: 4,553,909

[45] Date of Patent: Nov. 19, 1985

[54] MOTOR-PUMP SET FOR BOREHOLES AND A METHOD OF PROTECTION RELATING THERETO

[75] Inventors: Michel Galais, Angouleme; Christian Sardain, Delle; Jean Fouin, Angouleme; Marcel Arnaudeau, Paris; Pierre Morin, Levallois-Perret, all of France

[73] Assignee: Moteurs Leroy-Somer, Angouleme Cedex, France

[21] Appl. No.: 500,177

[22] Filed: Jun. 1, 1983

[30] Foreign Application Priority Data

Jun. 4, 1982 [FR] France ..... 82 09745

[51] Int. Cl.[4] ..... F04B 17/00

[52] U.S. Cl. ..... 417/369; 417/372; 415/111; 415/176

[58] Field of Search ..... 417/372, 366, 368, 370, 417/414, 424, 369; 310/87, 90; 415/175, 176, 169 R, 110, 111, 112, 168

[56] References Cited

U.S. PATENT DOCUMENTS

| | | | |
|---|---|---|---|
| 2,001,172 | 5/1935 | Wintroath | 310/87 |
| 2,043,236 | 6/1936 | Conant | 417/424 |
| 2,783,400 | 2/1957 | Arutunoff | 310/87 |
| 2,809,590 | 10/1957 | Brown | 417/370 |
| 3,022,739 | 2/1962 | Herrick et al. | 417/369 |
| 3,288,075 | 11/1966 | Lung . | |
| 3,850,550 | 11/1974 | Kaessen | 415/111 |
| 3,975,117 | 8/1976 | Carter | 417/370 |

*Primary Examiner*—Cornelius J. Husar
*Assistant Examiner*—Peter M. Cuomo
*Attorney, Agent, or Firm*—Young & Thompson

[57] ABSTRACT

A motor pump set having two coaxial shafts is provided with a fluid circuit for protecting the rotary packing-gland against any ingress of solid particles such as sand. Pumped fluid is withdrawn from an intermediate space of the pump and returned upstream via a duct within the pump shaft in order to lubricate the bearings as it passes. The fraction of the fluid stream which is discharged from the last bearing flows in the vicinity of the packing-gland and is driven through radial discharge ducts under the action of centrifugal force.

1 Claim, 3 Drawing Figures

MOTOR-PUMP SET FOR BOREHOLES AND A METHOD OF PROTECTION RELATING THERETO

This invention relates to a motor-pump set for boreholes and in particular for pumping hydrocarbons, said pump set being intended to be immersed in an external medium.

The invention further relates to a method of protection relating to the pump set under consideration.

Known pumping units of this type comprise a motor housed within a fluid-tight casing and coupled axially to a pump housed within a cylindrical body and formed by a certain number of stages. A sealing system usually placed on the emergent end of the motor shaft close to the point of coupling with the pump ensures fluid-tightness of the motor casing in order to prevent the fluid which is being pumped and in which the pump set is immersed from penetrating into the casing. Deficient fluid-tightness in fact leads to rapid destruction of the motor as a result of two combined phenomena. On the one hand, penetration of solid particles of the sand type causes wear followed by seizure of thrust-bearings and journal-bearings. On the other hand, any penetration of the pumped fluid which usually contains an appreciable proportion of water highly charged with salts causes destruction of the electric windings.

In point of fact, the motor together with its sealing system is usually located beneath the pump. And the sealing system usually comprises a rotary mechanical packing-gland, one of the cooperating elements of which is in direct contact with the particles in suspension in the pumped fluid. These particles are liable to accumulate in the vicinity of the packing-gland and to lead rapidly to damage of the cooperating elements.

It has been endeavored to overcome this drawback by means of a number of different conventional arrangements such as labyrinth seals or successive chambers surrounding the shaft and constituted by successive mechanical packing-glands forming baffle passages between which are located settling chambers for the particles. But this expedient merely serves to shift the problem since these chambers are progressively invaded. Furthermore, the effectiveness of such a settling process is dependent on the assumption that the position of the pump is close to the vertical.

The object of the present invention is to provide a motor-pump set in which the rotary mechanical packing-gland is sufficiently protected against damage caused by solid particles to ensure that its service life is at least of the same order of magnitude as the interval between two operations involving routine maintenance of the pump set.

This result is achieved in accordance with the invention by means of a scavenging fluid circuit which connects a mean-radius zone of an intermediate stage of the pump to ducts for discharging fluid to the external medium, the scavenging circuit being intended to pass in the vicinity of the sealing system.

During operation of the motor-pump set, the above-mentioned scavenging fluid circuit continuously sweeps the zone in the vicinity of the sealing system by means of a clean fluid by virtue of the fact that the scavenging fluid is withdrawn from a mean radius of the pump, the solid particles of the pumped fluid being removed from the draw-off zone by centrifugation.

In an advantageous embodiment of the invention, the scavenging fluid circuit comprises a duct which is bored along the axis of the pump shaft and passes through an annular space formed by the radial gap of the bearing which carries said shaft and is nearest the motor.

The stream which thus flows through said annular space of a bearing performs an additional protective function by stopping any particles which may reach this level.

In a preferred embodiment of the invention, the scavenging fluid circuit comprises an annular portion formed around the shafts and limited externally by a tubular section which is rigidly fixed to the pump body, the pumped fluid circuit being also annular and located externally of said tubular section, with the result that the scavenging fluid circuit is totally isolated from the pumped fluid circuit.

In an improved embodiment of the invention, provision is made within the tubular section for a protective member keyed on the shaft and located on the pump side with respect to the sealing system, the diameter of said protective member being larger than that of said sealing system.

In the case of an arrangement of the pump set in the vicinity of the vertical plane, said protective member constitutes, especially during stationary periods of the pump, a protective cap for the packing-gland by preventing the particles from being deposited on said packing-gland.

The protective member is advantageously provided with a peripheral flange which extends to the internal wall of the motor casing in order to improve the effectiveness of protection.

Furthermore, the flange of the protective member forms in conjunction with a packing-gland supporting member an annular space which is located opposite to the discharge ducts.

In consequence, a centrifugal force is developed within said annular space and has an impelling effect on the scavenging fluid.

According to a second aspect of the invention, the method of protection of the packing-gland of a motor-pump set for a borehole essentially consists in withdrawing a selected fraction of the pumped fluid from an intermediate space of the pump in order to return said fraction to the vicinity of the sealing system, to utilize said fraction as a washing fluid, and then to discharge it to the external medium.

Other features of the invention will be more apparent upon consideration of the following description and accompanying drawings, wherein.

Figure 1:
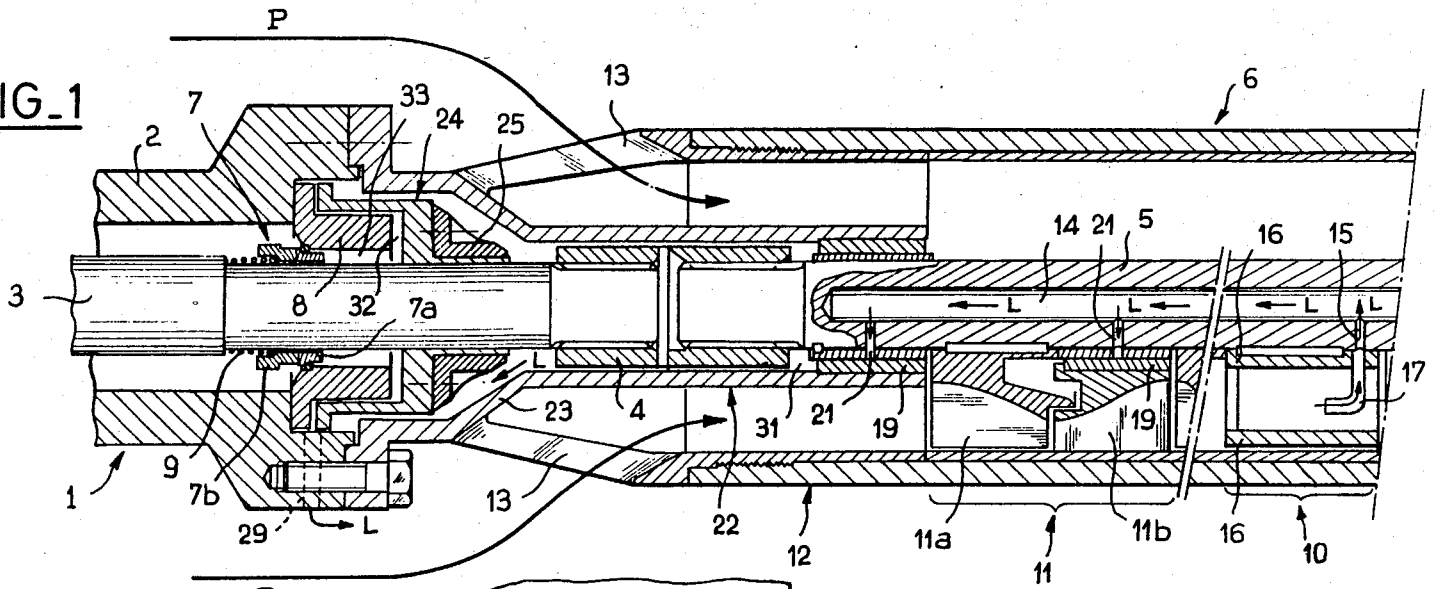
FIG. 1 is a fragmentary longitudinal sectional view of a motor-pump set in accordance with the invention.

Referring to FIG. 1, the motor-pump set comprises a motor 1 housed within a fluid-tight casing 2 filled with lubricant, the driving shaft 3 of the motor being coupled to the shaft of a pump 6 by means of a sleeve 4.

The shaft 3 emerges from the casing 2 through a rotary mechanical packing-gland 7 which ensures fluid-tightness of the passage. Said packing-gland is composed of a stationary portion *7a* fixed on a supporting member 8 which is in turn rigidly fixed to the casing 2, and of a rotary portion *7b* which is fixed on the shaft and applied against the stationary portion 7*a* by means of a spring 9.

The pump 6 comprises a plurality of stages 11 in series, each stage being composed of moving vanes 11*a* keyed on the shaft 5 and of stationary vanes 11*b* rigidly fixed to a substantially cylindrical pump body 12 which is bolted to the casing 2.

In the vicinity of its connection to the motor, the pump body 12 is provided with a plurality of peripheral windows 13 constituting the suction ports of the pump through which the pumped fluid penetrates in the direction of the arrows P into the annular space formed between a tubular section 22 and the pump body 12 to which said tubular section is rigidly fixed.

The shaft 5 has an axial bore or duct 14 which communicates on the right-hand side of FIG. 1 with a radial duct 15 formed within the shaft 5 and within a ring 16 which surrounds said shaft opposite to an intermediate space 10 of the pump, said space being located between two series of stages. A duct 17 is located opposite to the duct 15 and is elbowed in order to open into a mean-radius zone of the pump.

At the level of each of the bearings 19 which are located upstream (with respect to the pumping direction), the shaft 5 has a radial duct 21 which opens into the radial gap between the bearing and the corresponding ring.

Figure 3:
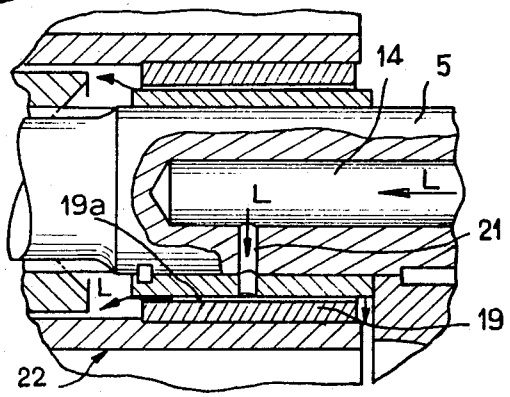
FIG. 3 is an enlarged view of part of FIG. 1 and shows the bearing through which the fluid circuit passes.

The last bearing 19 near the end of the shaft 5 (more clearly visible in FIG. 3) is carried by the tubular section 22 which is concentric with the pump body 12 and rigidly fixed to said body by means of a conical section 23 which is flared-out towards the motor.

At the level of said flared-out section, a protective member 24 is keyed on the shaft 3 of the motor by means of a sleeve 25.

Figure 2:
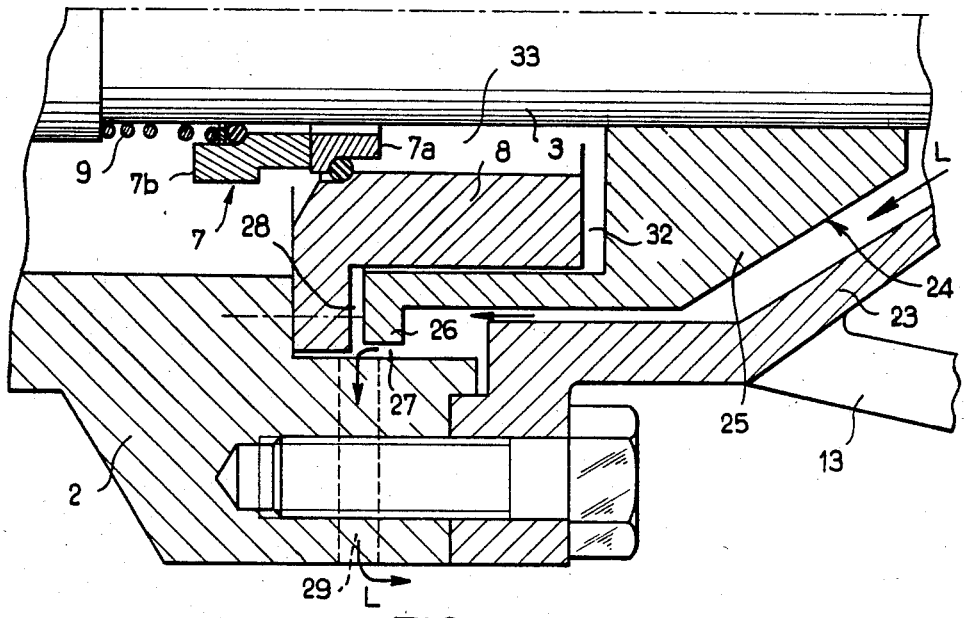
FIG. 2 is an enlarged view of part of FIG. 1 and shows the discharge ducts.

The protective member 24 which is located on the pump side with respect to the packing-gland 7 has a larger diameter than said gland and is provided with a peripheral flange 26 which extends to the internal wall of the motor casing 2, thus forming a gap 27 between said flange and said wall (as shown in FIG. 2).

In conjunction with the member 8 which supports the packing-gland 7, the peripheral flange 26 of said protective member leaves a flat annular space 28 opposite to which are formed radial discharge ducts 29.

When the motor is rotating, the pumped fluid is subjected to the pressure developed by the pump within the intermediate space 10, is thus caused to flow through the elbowed duct 17 and through the radial duct 15, then returns through the axial duct 14 in the upstream direction as indicated by the arrows L in FIG. 1. At the level of each bearing 19, part of said fluid escapes through the corresponding duct 21 towards the radial gap of the bearing in order to lubricate this latter, then returns to the pumping stream.

It will be noted that this drawn-off fluid is clean since it is taken from a mean radius of the fluid which is pumped in rotational motion. It is therefore free from solid particles which are impelled towards the wall of the pump body 12 by centrifugal force.

Within the last bearing 19 located nearest the motor, the liquid which escapes from the radial gap 19*a* of said bearing at the end nearest the motor is directed into the annular space 31 located between the shafts and the tubular section 22, reaches the gap 27 between the flange 26 of the protective member 24 and the casing 2, and is discharged through the ducts 29 under the action of centrifugal force produced by the wall effect of the flange 26.

This driving effect produced by centrifugation also applies to the fluid which is present within the spaces 32 and 28 located between the supporting member 8 of the stationary packing-ring of the packing-gland 7 and the protective member 24, this fluid being derived from a very small flow which infiltrates between the two members 7*a*, 7*b* of the packing-gland 7.

The circuit L for drawn-off fluid which flows through the gap 27 and the duct 29 prevents penetration and accumulation of pumped fluid and of solid particles, with the result that the annular space 33 is permitted to remain filled with clean fluid derived from the motor.

If for any reason a particle from the drawn-off fluid circuit were to penetrate into the space 28 or even to reach the space 32, it would be driven out by centrifugal force.

When the pump is not in operation, the particles located within the interior of the pump settle along a flow path which is reverse to the direction of the arrows P and are therefore again outside the protected space. If some particles find their way to the interior of the tubular section 22, they will then be discharged as soon as the motor is re-started.

It will be readily understood that the invention is not limited to the example described in the foregoing but extends to any technological variant within the capacity of those versed in the art.

What is claimed is:

1. A motor-pump set for boreholes comprising a motor housed within a fluid tight casing (2) and having a motor shaft (3) extending from said casing (2) and coupled axially to a pump housed within a cylindrical body (12) and formed by a plurality of stages mounted on a pump shaft (5) for pumping an external fluid, a packing gland (7) placed on an emergent end of said motor shaft, and a scavenging fluid circuit (4) connected at one end to the inside of said pump and comprising a duct (14) which is bored along an axis of said pump shaft (5) and opens in a radial gap (19*a*) of a bearing (19) which carries said pump shaft (5) and is nearest the motor, said scavenging fluid circuit (L) further comprising an annular portion (31) located around said shafts (3, 5) and limited externally by a tubular section (22) and a conical section (23) which are rigidly fixed to the pump body (12), provision being made within said conical section (23) for a protective member (24) keyed on said motor shaft (3) and located on the pump side with respect to the packing gland (7), the diameter of said protective member (24) being larger than that of said sealing system (7) and said protective member (24) being provided with a peripheral flange (26) which extends to the internal wall of the motor casing (2) at a level corresponding to discharge ducts (29) within said motor casing (2) so that said flange (26) of said protective member (24) forms in conjunction with a packing gland supporting member (8) a flat annular space (28) which is located opposite to said discharge ducts (29).

* * * * *